US008539890B2

(12) United States Patent
Tripp et al.

(10) Patent No.: US 8,539,890 B2
(45) Date of Patent: Sep. 24, 2013

(54) FLUID DISPENSING APPARATUS

(75) Inventors: Nicholas Tripp, Cornwall (GB); Philip Hammond, Cornwall (GB); Martin Wastell, Cornwall (GB)

(73) Assignee: Spinnaker International Limited, Cornwall (GB)

( * ) Notice: Subject to any disclaimer, the term of this patent is extended or adjusted under 35 U.S.C. 154(b) by 0 days.

(21) Appl. No.: 13/583,362

(22) PCT Filed: Feb. 23, 2011

(86) PCT No.: PCT/GB2011/050349

§ 371 (c)(1),
(2), (4) Date: Oct. 1, 2012

(87) PCT Pub. No.: WO2011/110830

PCT Pub. Date: Sep. 15, 2011

(65) Prior Publication Data

US 2013/0032067 A1 Feb. 7, 2013

(30) Foreign Application Priority Data

Mar. 9, 2010 (GB) ..... 1003869.3

(51) Int. Cl.
*E05G 1/00* (2006.01)

(52) U.S. Cl.
USPC ..... 109/25; 109/29

(58) Field of Classification Search
USPC ..... 109/25, 29, 32, 33, 36, 37
See application file for complete search history.

(56) References Cited

U.S. PATENT DOCUMENTS 3,096,940 A * 7/1963 Burleigh ..... 239/272
6,568,336 B2 * 5/2003 Van Lint ..... 109/29

FOREIGN PATENT DOCUMENTS

| | | | |
|---|---|---|---|
| EP | 0333075 | A2 | 9/1989 |
| EP | 0561292 | A2 | 9/1993 |
| GB | 2 390 055 | A | 12/2003 |
| WO | WO9803758 | A1 | 1/1998 |
| WO | WO9960502 | A1 | 11/1999 |
| WO | 2007/006955 | A1 | 1/2007 |

OTHER PUBLICATIONS

United Kingdom Intellectual Property Office, Search Report for GB 1003869.3 dated Jul. 8, 2010, 3 pages.

* cited by examiner

*Primary Examiner* — Suzanne Barrett
(74) *Attorney, Agent, or Firm* — Kilpatrick Townsend & Stockton LLP

(57) ABSTRACT

A fluid dispensing apparatus (10) comprising a collapsible bellows (12) for storing the fluid to be dispensed, a housing (14) for receiving the collapsible bellows and means (30) for compressing the collapsible bellows on actuation of the fluid dispensing apparatus (10) so as to eject the fluid through an outlet (22) of the bellows (12), wherein the housing (14) is configured to guide the bellows (12) so as to impede lateral deformation of the bellows (12) during compression thereof.

11 Claims, 4 Drawing Sheets

FLUID DISPENSING APPARATUS

CROSS-REFERENCES TO RELATED APPLICATION

The present application claims priority to PCT/GB2011/050349, filed Feb. 23, 2011, which claims priority to Great Britain Patent Application No. 1003869.3, filed Mar. 9, 2009 entitled "A FLUID DISPENSING APPARATUS" incorporated by reference for all purposes.

TECHNICAL FIELD

The present invention relates to a fluid dispensing apparatus. In particular, the present invention relates to a fluid dispensing apparatus which is suitable for use in a container such as an ATM cassette.

BACKGROUND TO THE INVENTION

In order to facilitate the process of replenishing automated teller machines (ATMs) it is common for cassettes to be used to store bank notes, both in the ATM and in transit to and from ATMs. An empty ATM cassette can simply be removed from the ATM and replaced with a cassette which has been prefilled with bank notes.

ATM cassettes are an attractive target for thieves, since they may contain 2000 bank notes or more, and are particularly vulnerable to theft during transportation and delivery to an ATM. To deter thieves, it is commonplace for ATM cassettes to be provided with spoiling or degradation systems which dispense an indelible dye, ink, or other spoiling or degrading agent onto the notes in the event of an attempted theft, thereby rendering the notes unusable.

In some spoiling systems a dispensing mechanism for dispensing the spoiling or degrading agent is mounted in a lid of the ATM cassette. However, due to complex design and variations between models of ATM cassette it is not always possible to mount the dispensing mechanism in the lid.

One solution to this problem is to mount the dispensing mechanism in the base of the ATM cassette. However, this can reduce the note carrying capacity of the ATM cassette, thereby increasing the frequency with which the cassette has to be replaced or replenished. This is undesirable, as ATM operators typically have to pay a fee to a licensed security company for replenishing the ATM, and thus reducing the frequency of replenishment of the ATM reduces cost for the ATM operator.

A common method of implementing a base-mounted dispensing mechanism is to store the spoiling or degradation agent in a cylinder or bore, with a piston being used to compress the spoiling or degrading agent on actuation of a spoiling or degradation system, forcing the spoiling or degrading agent through a valve and subsequently onto the notes contained in the ATM cassette. A problem with this type of system is that in order to obtain a satisfactory seal between the piston and the bore to ensure that there can be no leakage of the spoiling or degradation agent, the bore must be machined from a metal such as aluminium. The weight of a metallic bore produced in this way which is large enough to hold sufficient spoiling or degrading agent to spoil 2000 notes is substantial. Given that a cash in transit company will typically handle a large number of ATM cassettes at one time any excess weight is highly undesirable. Moreover, the cost of manufacturing a bore with sufficient precision to ensure a good quality seal between the bore and the piston and to prevent skewing of the piston in travel is prohibitive.

SUMMARY OF INVENTION

According to a first aspect of the present invention there is provided a fluid dispensing apparatus comprising a collapsible bellows for storing the fluid to be dispensed, a housing for receiving the collapsible bellows and means for compressing the collapsible bellows on actuation of the fluid dispensing apparatus so as to eject the fluid through an outlet of the bellows, wherein the housing is configured to guide the bellows so as to impede lateral deformation of the bellows during compression thereof.

The fluid dispensing apparatus of the present invention provides a compact, lightweight and low cost solution to the problem of mounting a spoiling or degradation agent dispensing system in the base of an ATM cassette or the like.

The bellows may comprise a closure at one end thereof, which closure may extend longitudinally inwardly of the bellows.

The means for compressing the collapsible bellows may comprise a source of gas.

For example, the source of gas may comprise a gas generator.

Alternatively, the source of gas may be a source of pressurised gas.

The fluid dispensing apparatus may further comprise a seal for creating an airtight seal between an outer part of the bellows and an inner wall of the housing.

The housing may comprise exhaust ports, which exhaust ports may be positioned such that prior to actuation of the apparatus gas cannot escape from the housing and after actuation of the apparatus gas can escape from the housing through the exhaust ports.

The fluid dispensing apparatus may further comprise a hollow needle which communicates with the outlet of the bellows, the needle extending into an interior of the bellows towards a closure thereof such that on compression of the bellows the needle pierces the closure, thereby permitting gas to escape from the housing through the outlet.

The needle may comprise an aperture which, when the bellows is fully compressed, is positioned in the interior of the bellows such that excess fluid can escape through the needle.

The fluid dispensing apparatus may further comprise a cap for sealing the housing, and the means for compressing the collapsible bellows may be positioned outside the housing when it is sealed by the cap.

The housing may be of a plastics material.

According to a second aspect of the present invention there is provided a collapsible bellows for a fluid dispensing apparatus according to the first aspect.

According to a third aspect of the present invention there is provided an ATM cassette comprising a fluid dispensing apparatus according to the first aspect.

BRIEF DESCRIPTION OF THE DRAWINGS

Embodiments of the invention will now be described, strictly by way of example only, with reference to the accompanying drawings, of which.

DESCRIPTION OF THE EMBODIMENTS

Figure 1:
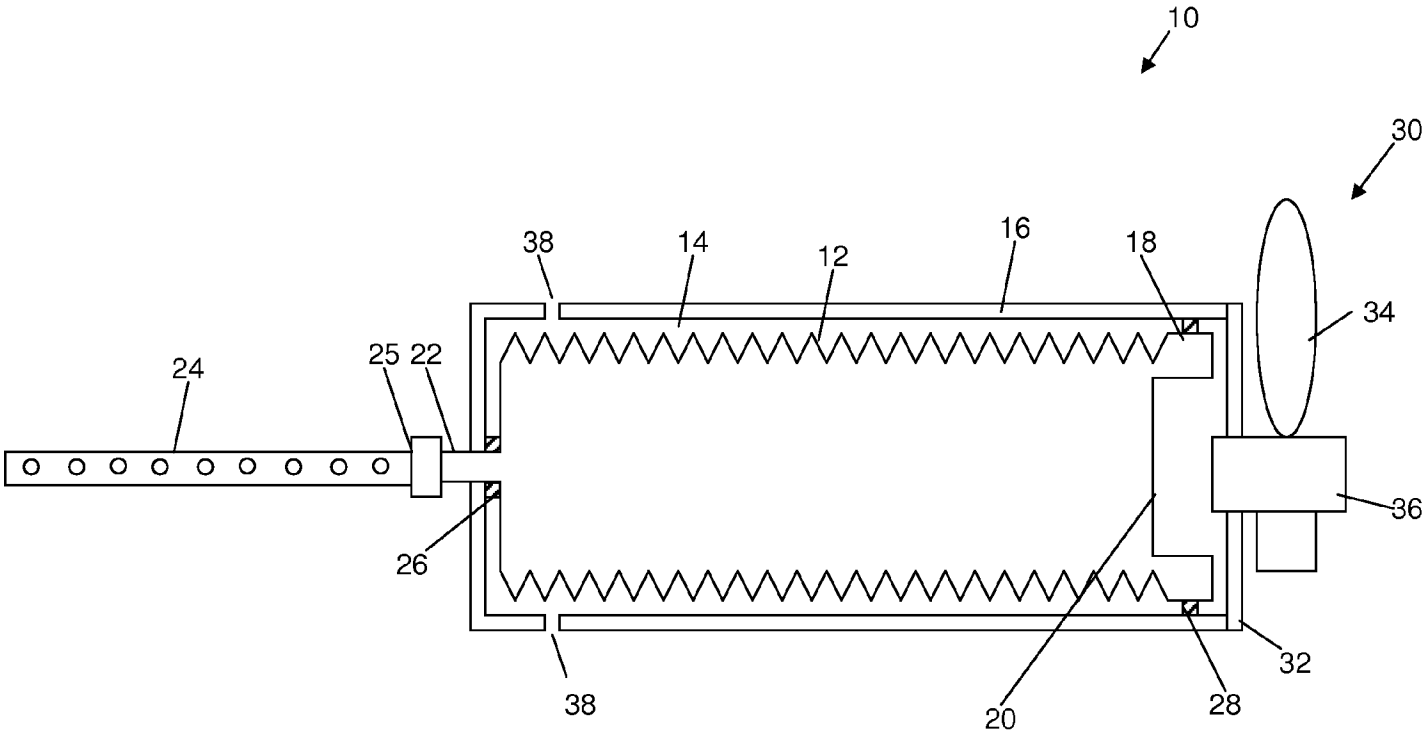
FIG. 1 is a schematic representation showing, in cross-section, an embodiment of fluid dispensing apparatus in an uncompressed state.

Referring first to FIG. 1, a fluid dispensing apparatus is shown generally at 10, and includes a collapsible bellows 12 containing a fluid spoiling or degrading agent such as indelible ink, adhesive or the like. The bellows 12 is housed in a bore 14 of a housing 16 of a lightweight plastics material. The housing 16 may be formed, for example, by extrusion of a plastics material, whilst the bellows 12 may be formed by blow-moulding a plastics material.

In this example the bellows 12 is generally cylindrical, and the housing 16 has a generally cylindrical bore 14 of a slightly larger diameter than that of the bellows 12, but it is to be appreciated that the bellows 12 may take any form.

One function of the bore 14 of the housing 16 is to guide the bellows 12 during compression to ensure that the bellows 12 compresses in a direction generally along a longitudinal axis thereof, to prevent or at least impede skewing or undesired lateral deformation of the bellows 12 during compression. Thus, it is advantageous for the bore 14 to have a generally similar form to that of the bellows 12.

The bellows 12 is closed at a first end 18 thereof by a closure 20 which extends longitudinally inwardly of the bellows 12, whilst an outlet 22 is provided at the other end of the bellows 12. The outlet 22 communicates with a spray bar 24 which is provided with a plurality of outlet apertures through which a spoiling or degrading agent can be dispensed onto bank notes stored in an ATM cassette, security container or the like. A valve 25 is disposed between the outlet and the spray bar 24 to prevent the spoiling or degrading agent from escaping from the bellows 12 until the apparatus 10 is actuated to compress the bellows 12.

The bellows 12 is sealed at its outlet end to the housing 16 by means of a first O-ring seal 26 of rubber or a similar material. The first O-ring seal prevents gas from escaping from the bore 14 of the housing 16.

A second O-ring seal 28 is provided towards the other end 18 of the bellows 12, creating an airtight seal between an outer part of the bellows 12 and an inner wall of the bore 14, thereby preventing gas from escaping around the outside of the bellows 12.

A compression system 30 is mounted on a cap 32 of the housing 16, such that the compression system 30 is positioned outside the housing 16 when the housing 16 is closed by the cap 32. The cap 32 forms an airtight seal for the bore 14 and is removable for maintenance purposes, for example replacement of the bellows 12.

The compression system 30 has a cartridge or cylinder 34 of compressed gas such as carbon dioxide which is sealed by an actuator 36 such as an explosive protractor or an electrically operated valve. The actuator 36 is connected to a theft or interference detection system and is configured, on actuation, to permit the pressurised gas stored in the cylinder 34 to be released into the sealed bore 14. This release of the pressurised gas into the sealed bore 14 causes the bellows 12 to be compressed, which in turn causes the spoiling or degrading agent to be ejected from the bellows 12 through the outlet 22, from where it passes to the spray bar 24 and is dispensed through the outlet apertures.

The bore 14 is provided with exhaust ports 38 through which gas from the cylinder 34 can escape from the bore 14 of the housing 16 once the bellows 12 has been fully compressed to ensure that the housing 16 does not remain pressurised after activation of the fluid dispensing apparatus 10, thus permitting safe handling of the housing 16 by an operator or service personnel. When the bellows 12 is not fully compressed the second O-ring seal 28 prevents gas from escaping through the exhaust ports 38.

Figure 2:
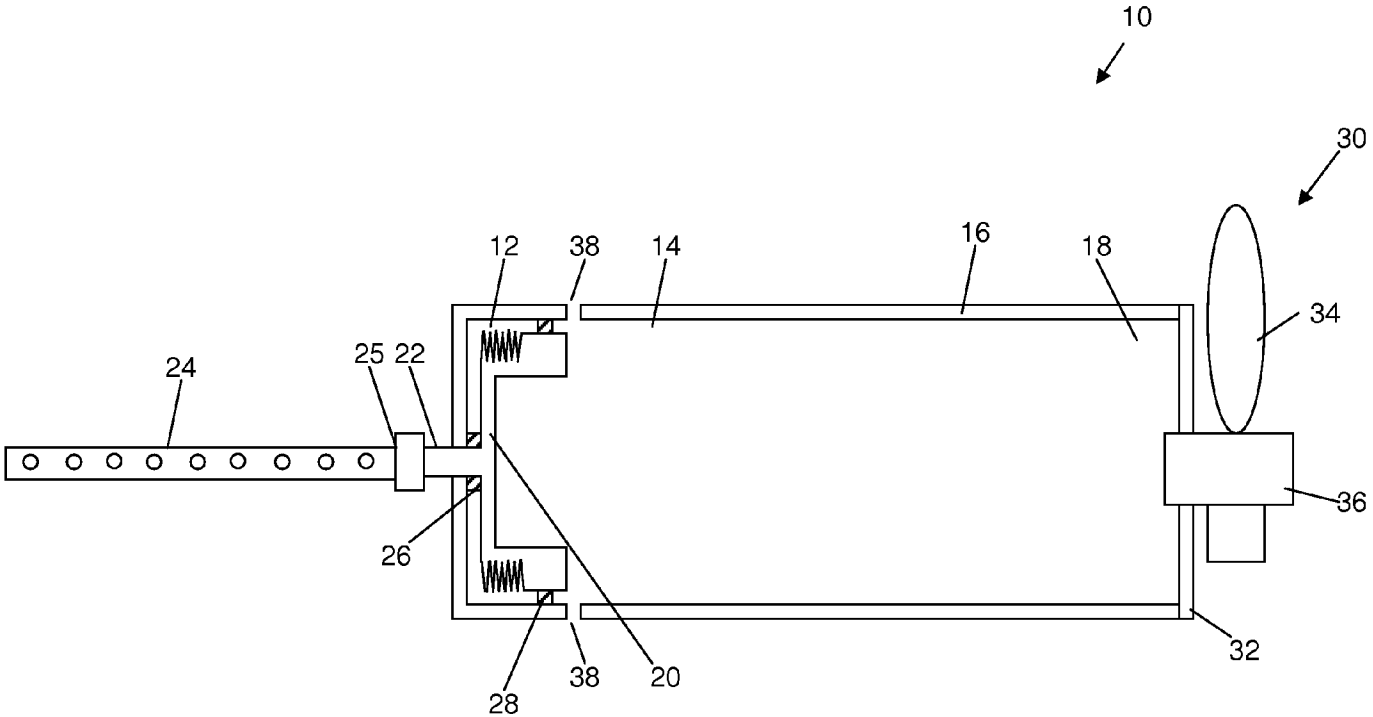
FIG. 2 is a schematic representation showing, in cross-section, the fluid dispensing apparatus of FIG. 1 in a compressed state.

Referring now to FIG. 2, the fluid dispensing apparatus 10 of FIG. 1 is shown in an actuated condition, with the bellows 12 fully compressed. It can clearly be seen from FIG. 2 that in this actuated condition the bellows 12 is compressed to the point that the second O-ring seal 28 has moved past the exhaust ports 38, thus permitting the safe release of the pressurised gas from the sealed bore 14.

FIG. 2 also illustrates the function of the inwardly-extending closure 20 of the bellows 12. The inwardly-extending closure 20 ensures that substantially all of the spoiling or degrading agent stored in the bellows 12 is ejected through the outlet on activation of the apparatus 10. The inwardly-extending closure 20 ensures that the uncompressed volume within the bellows 12 when it has been fully compressed by the pressurised gas is as small as possible, thereby ensuring that as much as possible of the spoiling or degrading agent stored in the bellows 12 is ejected during compression of the bellows 12.

Figure 3:
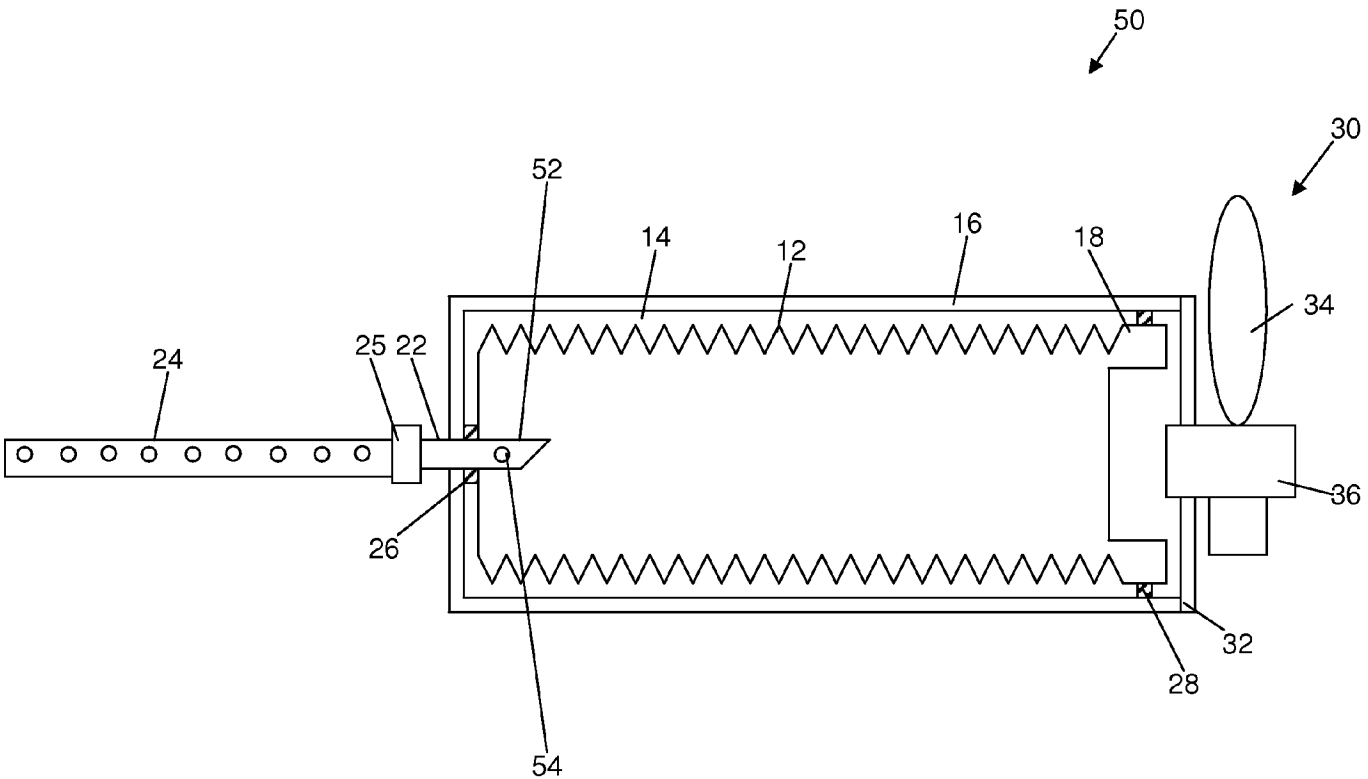
FIG. 3 is a schematic representation showing, in cross-section, an alternative embodiment of a fluid dispensing apparatus is an uncompressed state.

FIG. 3 is a schematic cross-sectional view of an alternative embodiment of a fluid dispensing apparatus 50. The embodiment shown in FIG. 3 includes many of the elements present in the embodiment of FIGS. 1 and 2, and thus the same reference numerals have been used to designate elements which are common to both embodiments.

In the fluid dispensing apparatus 50 of FIG. 3 there are no exhaust ports. Instead, to ensure safe venting of the compressed gas following activation of the apparatus 50 a hollow needle 52 is provided, which needle 52 extends into the interior of the bellows 12 towards the closure 20. The needle 52 communicates with outlet 22 of the bellows 12.

Figure 4:
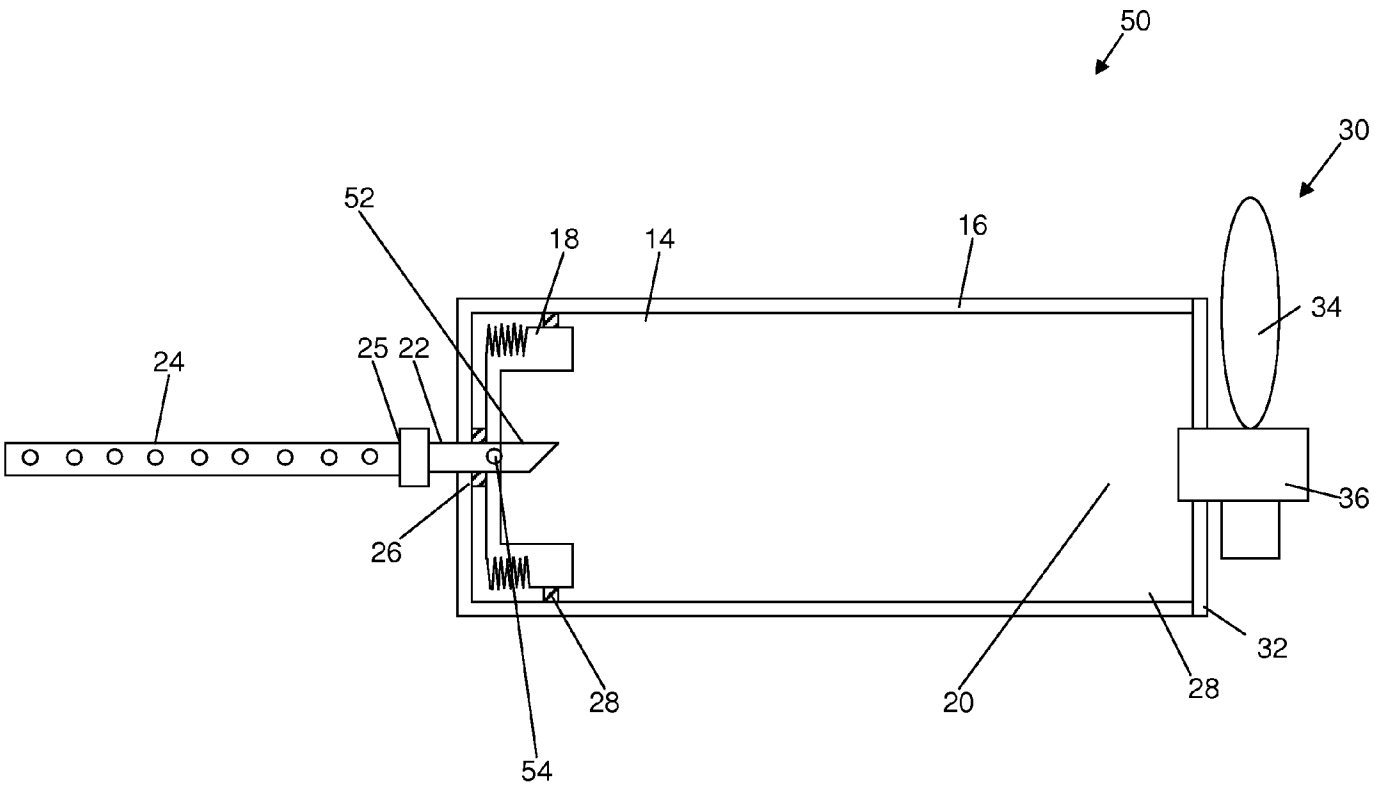
FIG. 4 is a schematic representation showing, in cross-section, the fluid dispensing apparatus of FIG. 3 in a compressed state.

As is shown in FIG. 4, when the bellows 12 is completely compressed, the hollow needle 52 pierces the closure 20, permitting compressed gas in the bore 14 of the sealed housing 16 to escape through the outlet 22 and the spray bar 24. The hollow needle 52 is provided with an aperture 54, which, when the bellows 12 is fully compressed, is positioned in the interior of the bellows 12 such that excess spoiling or degrading agent in the bellows 12 can be ejected from the bellows 12 with the compressed gas being vented through the hollow needle 52.

In a further alternative embodiment, the apparatus 50 may be provided both with exhaust ports 38 and with a hollow needle 52 as described above to ensure effective and safe venting of compressed gas from the bore 14 of the housing 16.

Although the fluid dispensing apparatus 10, 50 described above has a compression system 30 which uses a source of pressurised gas to cause compression of the bellows 12 on actuation of the apparatus 10, 50, it will be appreciated that alternative compression systems could be used. For example, the compression system 30 may be replaced by a pneumatically—or hydraulically operated piston or a solenoid which is operative to compress the bellows 12 on actuation of the apparatus 10, 50 or by a compression system which employs a gas generator to generate gas to compress the bellows 12.

Similarly, alternative components can be used in place of the spray bar 24 to direct the spoiling or degrading agent onto bank notes, documents or other valuable items, For example, an injector-style component, as is described in the applicant's European patent no. EP1499787B1, may be used in place of the spray bar 24.

The fluid dispensing apparatus 10 is particularly suited to use in ATM cassettes in which space is limited, but it will be clear that the fluid dispensing apparatus 10 is equally suited to other applications, for example use in security transit containers such as the iBox® supplied by the applicant, safes or any other container used for storing or transporting bank notes or other valuable items.

It will be appreciated that in certain applications more than one fluid dispensing apparatus 10 may be used. For example, where a two-part resin or adhesive is used as the spoiling or degrading agent, two fluid bellows 12 may be used, with one holding a first part of the two-part spoiling or degrading agent and the other holding the second part of the two-part spoiling or degrading agent, such that on actuation of the apparatus 10 the first part of the two-part spoiling or degrading agent is ejected from one bellows 12 onto the bank notes, documents or other valuable items, and the second part of the two-part spoiling or degrading agent is ejected from the other bellows 12 onto the bank notes, documents or other valuable items, causing the two parts of the spoiling or degrading agent to mix and cure on the bank notes, documents or other valuable items, rendering them unusable.

The invention claimed is:

1. A fluid dispensing apparatus comprising:

a collapsible bellows for storing fluid to be dispensed;

a housing for receiving the collapsible bellows;

means for compressing the collapsible bellows on actuation of the fluid dispensing apparatus so as to eject the fluid through an outlet of the bellows, wherein the housing is configured to guide the bellows so as to impede lateral deformation of the bellows during compression thereof; and an exhaust port located in the housing through which gas can escape only after actuation of the fluid dispensing apparatus.

2. A fluid dispensing apparatus according to claim 1 wherein the bellows comprises a closure at one end thereof, wherein the closure extends longitudinally inwardly of the bellows.

3. A fluid dispensing apparatus according to claim 1 wherein the means for compressing the collapsible bellows comprises a source of gas.

4. A fluid dispensing apparatus according to claim 3 wherein the source of gas comprises a gas generator.

5. A fluid dispensing apparatus according to claim 3 wherein the source of gas is a source of pressurised gas.

6. A fluid dispensing apparatus according to claim 1 further comprising a seal for creating an airtight seal between an outer part of the bellows and an inner wall of the housing.

7. A fluid dispensing apparatus according to claim 1 further comprising a hollow needle which communicates with the outlet of the bellows, the needle extending into an interior of the bellows towards a closure thereof such that on compression of the bellows the needle pierces the closure, thereby permitting gas to escape from the housing through the outlet.

8. A fluid dispensing apparatus according to claim 7 wherein the needle comprises an aperture which, when the bellows is fully compressed, is positioned in the interior of the bellows such that excess fluid can escape through the needle.

9. A fluid dispensing apparatus according to claim 1 further comprising a cap for sealing the housing, wherein the means for compressing the collapsible bellows is positioned outside the housing when the housing is sealed by the cap.

10. A fluid dispensing apparatus according to claim 1, wherein the housing is of a plastics material.

11. An ATM cassette comprising a fluid dispensing apparatus according to claim 1.

* * * * *